US006077194A

United States Patent [19]

Chang

[11] Patent Number: 6,077,194

[45] Date of Patent: Jun. 20, 2000

[54] BODY TWIST EXERCISING TOY WITH SOUND AND LIGHT PRODUCING MEANS

[76] Inventor: Wei-Hwang Chang, 6/F., No. 136-2, Hsinyi Rd., Peitou Dist., Taipei City, Taiwan

[21] Appl. No.: 09/395,967

[22] Filed: Sep. 14, 1999

[51] Int. Cl.[7] ..... A63B 21/22

[52] U.S. Cl. ..... 482/8; 482/110

[58] Field of Search ..... 482/8, 44, 45, 482/46, 49, 81, 82, 93, 110, 148

[56] References Cited

U.S. PATENT DOCUMENTS

| | | | |
|---|---|---|---|
| 4,505,474 | 3/1985 | Mattox | 482/82 |
| 4,982,950 | 1/1991 | Petrosky | 482/45 |
| 5,904,640 | 5/1999 | Shahinian | 482/110 |

*Primary Examiner*—Glenn E. Richman
*Attorney, Agent, or Firm*—Rosenberg, Klein & Lee

[57] ABSTRACT

A body twist exercising toy, which includes a mounting base for fastening to the user's waist, a saucer turned about a pivot at a support arm at the mounting base, a buzzer and a digital display and a set of LEDs respectively mounted on the saucer on the outside, a battery mounted inside the saucer, switch means, and a circuit board mounted inside the saucer and connected to the battery through the switch means to control the operation of the buzzer, the digital display, and the LEDs, wherein when the user twist the body, the saucer is rotated, and a centrifugal force is produced to switch on switch means, causing the buzzer, the digital display and the LEDs to be driven by the circuit board to produce sound and lighting effects and to indicate the number of runs of the rotary motion of the saucer.

6 Claims, 5 Drawing Sheets

BODY TWIST EXERCISING TOY WITH SOUND AND LIGHT PRODUCING MEANS

BACKGROUND OF THE INVENTION

The present invention relates to an exercising toy, and more specifically to a body twist exercising toy, which produces sound and lighting effects when the user twists the body to rotate a saucer.

A variety of indoor exercising apparatus have been disclosed, and have appeared on the market. These indoor exercising apparatus are commonly heavy and expensive, and occupy much floor space. Further, young people and females tend to use a loop for exercising by twisting the body to turn the loop about the waist. However, it is monotonous to twist the body with a loop.

SUMMARY OF THE INVENTION

The present invention has been accomplished under the circumstances in view. It is one object of the present invention to provide a body twist exercising toy, which uses the inertial force of a rolling steel ball to move a saucer when the user twists the body, causing the saucer to be rotated on a pivot rod at a mounting base being fastened to the user's waist. It is another object of the present invention to provide a body twist exercising toy, which uses a centrifugal force to switch on a switch when the user twist the body, causing a circuit board to drive a buzzer and LEDs to produce sound and lighting effects.

DETAILED DESCRIPTION OF THE PREFERRED EMBODIMENT

Figure 1:
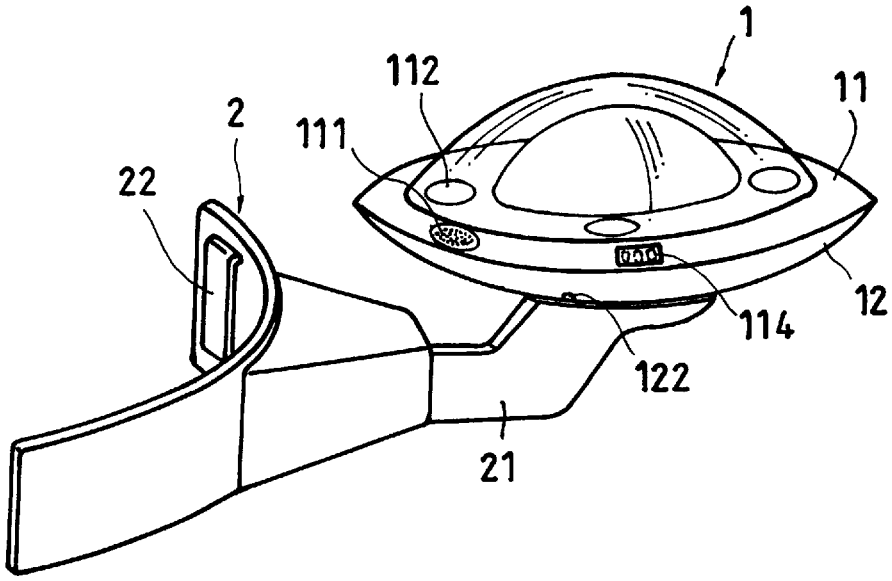
FIG. 1 is a perspective view of a body twist exercising toy according to the present invention.
Figure 2:
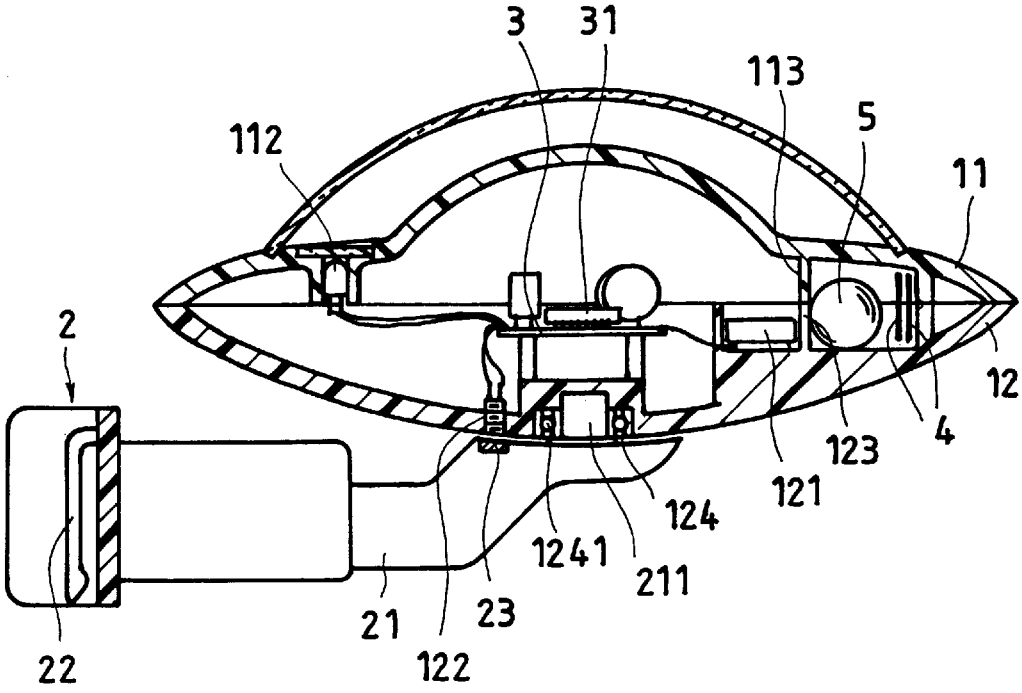
FIG. 2 is a side view in section of the body twist exercising toy according to the present invention.
Figure 3:
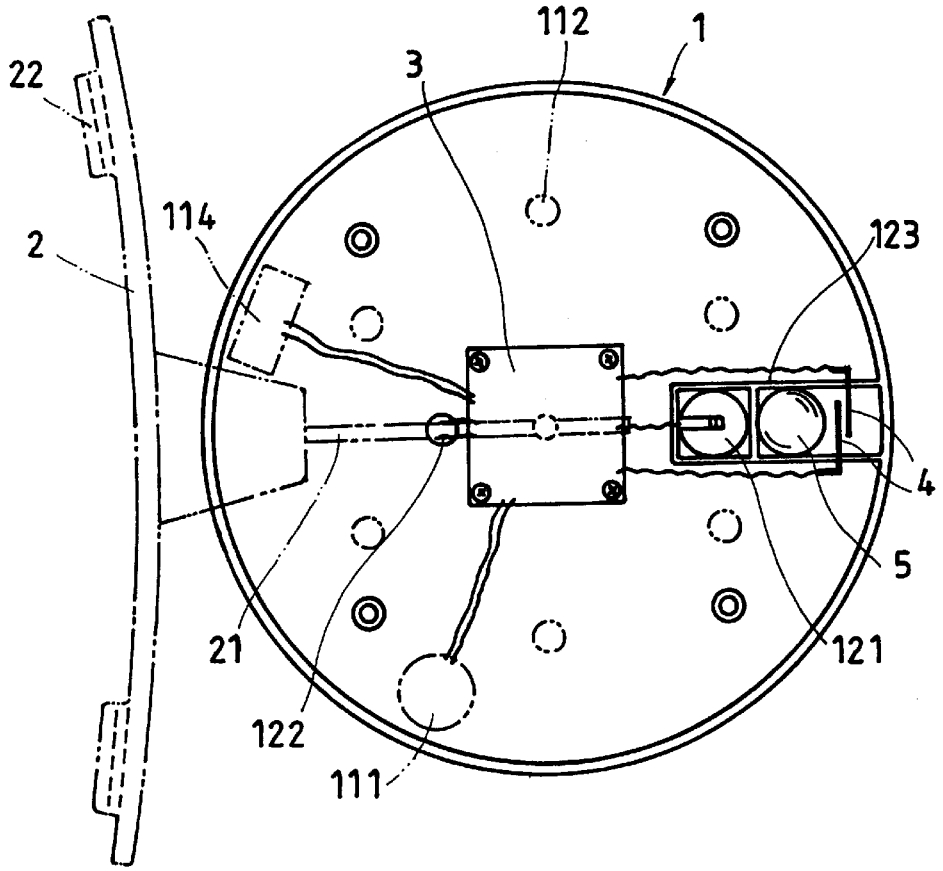
FIG. 3 is a top plain view of the present invention after removal of the top cover shell.

Referring to FIGS. 1 through 3, a body twist exercising toy is shown comprised of a saucer 1, a circuit board 3, a reed switch 4, a steel ball 5, a buzzer 111, a digital display 114, a battery 121, a solenoid inductor 122, a plurality of LEDs (light emitting diodes) 112, and a mounting base 2.

Figure 4:
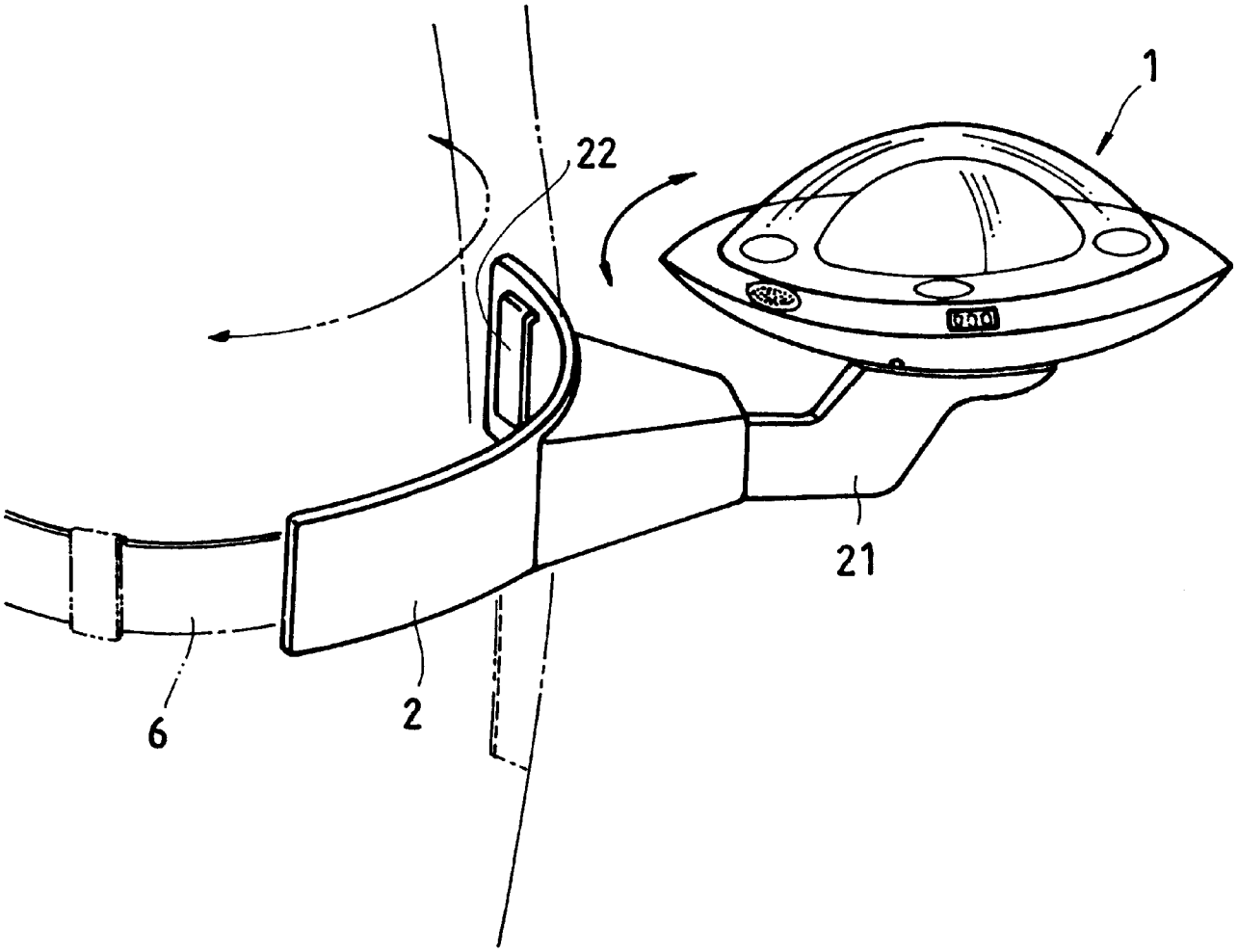
FIG. 4 is an applied view of the present invention, showing the body twist exercising toy fastened to the user's waist, and the user's body twisted.

The saucer 1 is comprised of a top cover shell 11 and a bottom cover shell 12. Meshed partition walls 113 and 123 are provided inside the cover shells 11 and 12, defining a receiving space for the positioning of the steel ball 5 and the reed switch 4. The circuit board 3 is mounted within the bottom cover shell 12 outside the meshed partition walls 123. The LEDs 112, the buzzer 111 and the digital display 114 are mounted on the outside wall of the top cover shell 11 around its border area, and respectively connected to the circuit board 3 by conductors. The battery 121 is mounted inside the bottom cover shell 12, and connected to the circuit board 3 through the reed switch 4. The bottom cover shell 12 has a bottom center hole 124 mounted with an axle bearing 1241. The mounting base 2 comprises a horizontal support arm 21 forwardly extended from a front side wall thereof, a pivot rod 211 vertically raised from the distal end of the support arm 21 and inserted into the axle bearing 1241 to support the saucer 1 on the support arm 21, and a plurality of clips 22 provided at a back side wall thereof for fastening to, for example, the user's waist belt 6 (see FIG. 4). When the user twist the body, the saucer 1 is rotated on the pivot rod 211, and at the same time the steel ball 5 is forced by a centrifugal force into contact with the reed switch 4, thereby causing the circuit board 3 to flash the LEDs 112, and simultaneously to trigger a music IC 31, which in turn drives the buzzer 111 to produce sound. Further, a magnet 23 is mounted on the support arm 21 corresponding to the solenoid inductor 122. During rotary motion of the saucer 1 on the pivot rod 211, the solenoid inductor 122 is induced by the magnet 23 to output an analog signal once per each run of the saucer 1, and the output signal of the solenoid inductor 122 is sent to the circuit board 3 for processing, enabling the number of runs of the saucer 1 to be indicated at the digital display 114.

Figure 5:
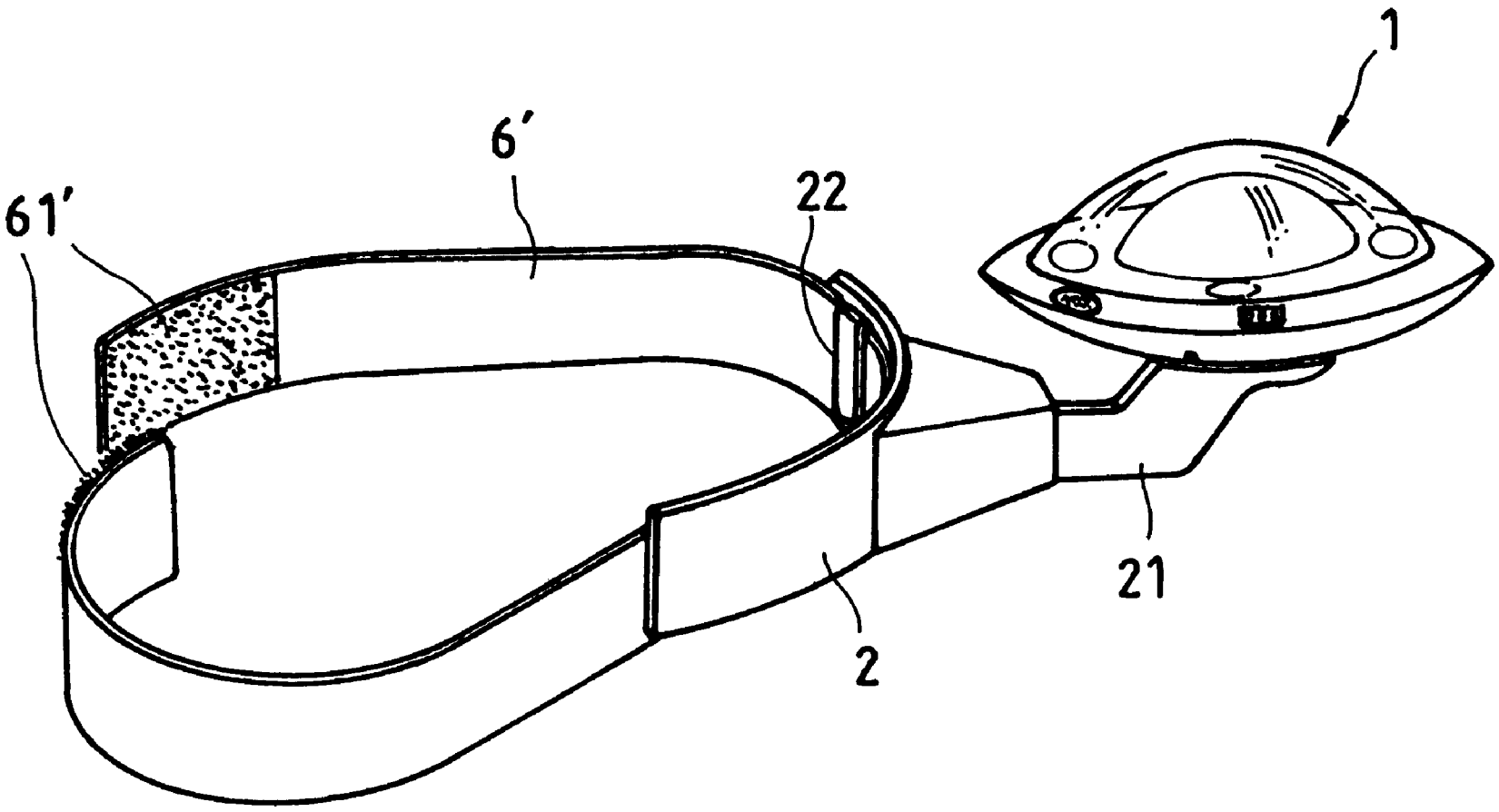
FIG. 5 illustrates the body twist exercising toy attached to a belt with hook and loop materials according to the present invention.

Referring to FIG. 5, a belt 6' which uses hook and loop materials 611' for joining its two ends may be fastened to the mounting base 2, enabling the mounting base 2 to be easily secured to the player's waist.

Figure 6:
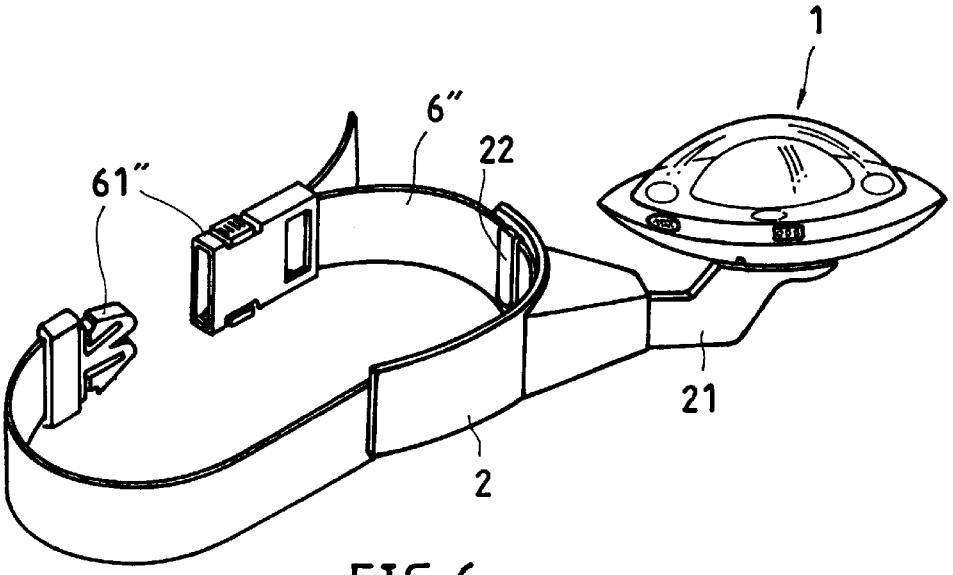
FIG. 6 illustrates the body twist exercising toy attached to a belt with a quick release hook according to the present invention.

Referring to FIG. 6, a belt 6" which uses a fastener, for example, a quick release hook 61" for joining its two ends may be fastened to the mounting base 2, enabling the mounting base 2 to be easily secured to the player's waist.

Figure 7:
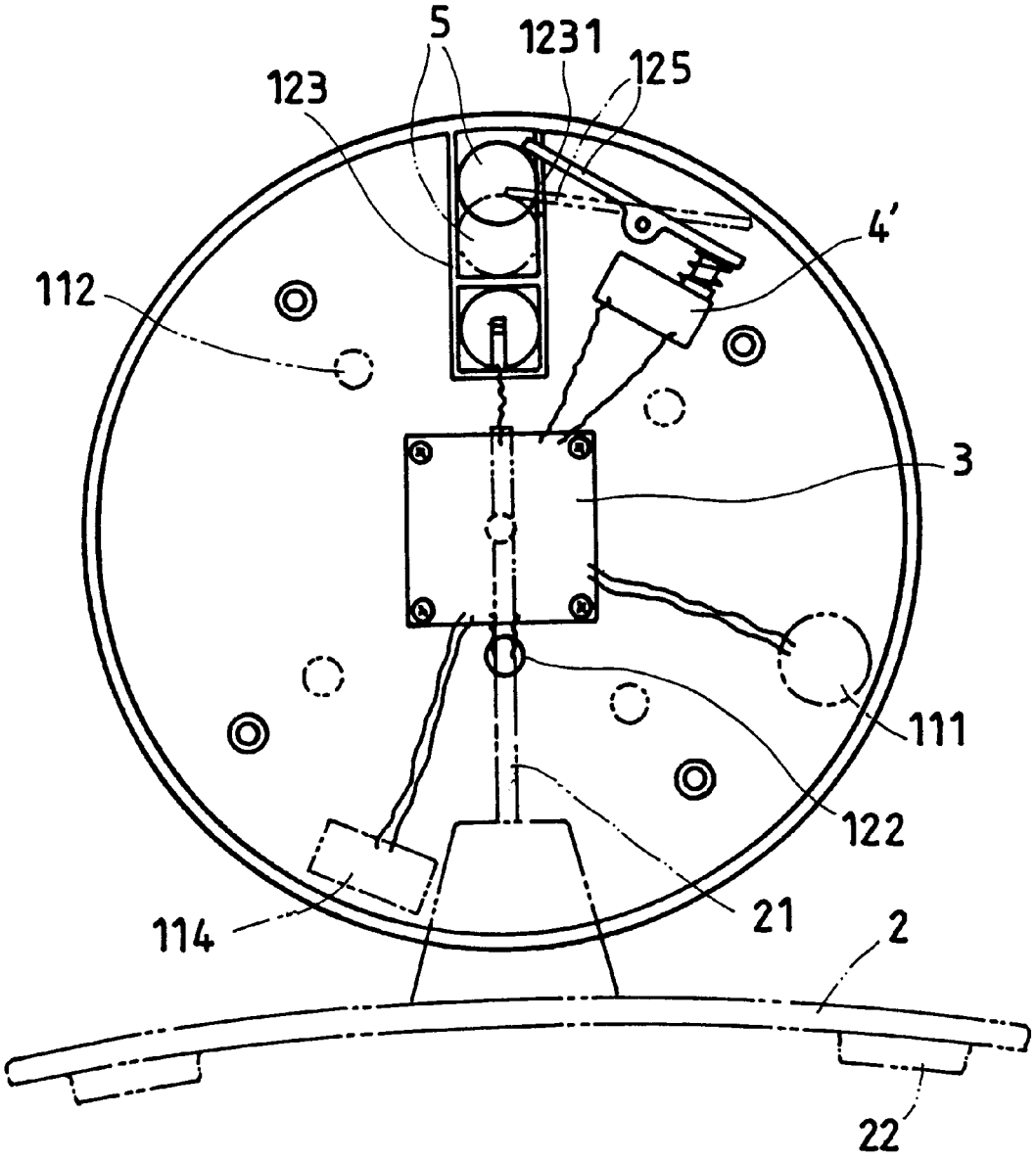
FIG. 7 illustrates an alternate form of the body twist exercising toy according to the present invention.

FIG. 7 shows an alternate form of the present invention. According to this alternate form, a swivel plate 125 is mounted inside the bottom cover shell 12 and turned about a pivot, having a first end inserted through an opening 1231 at the meshed partition walls 113 and 123 and a second end disposed in contact with a press button switch 4' inside the bottom cover shell 12. When the saucer 1 is rotated, an eccentric force is produced to force the steel ball 5 against the first end of the swivel plate 125, thereby causing the second end of the swivel plate 125 to press on the press button switch 4', and therefore the circuit board 3 is electrically connected to drive the buzzer 111 to produce a sound effect, and the LEDs 112 to produce a lighting effect.

It is to be understood that the drawings are designed for purposes of illustration only, and are not intended for use as a definition of the limits and scope of the invention disclosed.

What the invention claimed is:

1. A body twist exercising toy comprising:

a mounting base, said mounting base comprising a horizontal support arm at a front side thereof, a pivot rod vertically raised from said support arm, and clip means at a rear side thereof for fastening to the user's waist belt;

a saucer mounted on said support arm and rotated on said pivot rod at said support arm of said mounting base, said saucer comprising a bottom cover shell, a top cover shell covered on said bottom cover shell, and meshed partition means provided inside said bottom cover shell and said top cover shell and defining a receiving space;

a steel ball moved in the receiving space inside said saucer;

a reed switch mounted in the receiving space inside said saucer at one side;

a battery mounted inside said bottom cover shell outside said receiving space;

a plurality of light emitting diodes mounted on the top cover shell of said saucer on the outside and equiangularly spaced around the border of the top cover shell of said saucer; and a circuit board connected to said battery through said reed switch for controlling the operation of said light emitting diodes;

wherein when the user twists the body to move said mounting base, said saucer is rotated on the pivot rod at the support arm of said mounting base, and an centrifugal force is produced to force said steel ball into contact with said reed switch, causing said battery and said circuit board to be electrically connected, so that said light emitting diodes are controlled by said circuit board to produce a lighting effect.

2. The body twist exercising toy of claim 1 further comprising a buzzer mounted on said saucer, and controlled by said circuit board to produce a sound effect.

3. The body twist exercising toy of claim 1 further comprising a magnet fixedly mounted on said support arm, a solenoid inductor fixedly mounted on the bottom cover shell of said saucer and induced by said magnet to output a signal to said circuit board once per each run of said saucer when said saucer is rotated on said pivot rod, and a digital display mounted on said top cover shell and controlled by said circuit board to indicate the number of runs of said saucer on said pivot rod.

4. The body twist exercising toy of claim 1 wherein the bottom cover shell of said saucer comprises a bottom center hole, and an axle bearing mounted in said bottom center hole and supported on the pivot rod at the support arm of said mounting base.

5. The body twist exercising toy of claim 1 further comprising a fastening belt fixedly fastened to said mounting base for securing said mounting base to the user's waist.

6. A body twist exercising toy comprising:

a mounting base, said mounting base comprising a horizontal support arm at a front side thereof, a pivot rod vertically raised from said support arm, and clip means at a rear side thereof for fastening to the user's waist belt;

a saucer mounted on said support arm and rotated on said pivot rod at said support arm of said mounting base, said saucer comprising a bottom cover shell, a top cover shell covered on said bottom cover shell, and meshed partition means provided inside said bottom cover shell and said top cover shell and defining a receiving space;

a steel ball moved in the receiving space inside said saucer;

a press button switch mounted inside said bottom cover shell of said saucer;

a swivel plate mounted inside said bottom cover shell of said mounting base and turned about a pivot, said swivel plate having a first end inserted through an opening at the meshed partition means and a second end disposed in contact with said press button switch;

a battery mounted inside said bottom cover shell outside said receiving space;

a plurality of light emitting diodes mounted on the top cover shell of said saucer on the outside and equiangularly spaced around the border of the top cover shell of said saucer; and a circuit board connected to said battery through said press button switch for controlling the operation of said light emitting diodes;

wherein when the user twists the body to move said mounting base, said saucer is rotated on the pivot rod at the support arm of said mounting base, and an centrifugal force is produced to force said steel ball against the first end of said swivel plate, causing said swivel plate to switch on said press button switch, so that said battery and said circuit board are electrically connected, and said light emitting diodes are controlled by said circuit board to produce a lighting effect.

* * * * *